United States Patent [19]

Hoagland, Jr.

[11] 4,123,737

[45] Oct. 31, 1978

[54] BIMETALLIC CIRCUIT BREAKER

[75] Inventor: Porter Hoagland, Jr., Noank, Conn.

[73] Assignee: Heinemann Electric Company, Trenton, N.J.

[21] Appl. No.: 739,965

[22] Filed: Nov. 8, 1976

[51] Int. Cl.[2] ..... H01H 71/16

[52] U.S. Cl. ..... 337/68; 337/85

[58] Field of Search ..... 337/64, 66, 68, 85, 337/148

[56] References Cited

U.S. PATENT DOCUMENTS

| | | | |
|---|---|---|---|
| 2,487,422 | 11/1949 | Carle | 337/68 |
| 3,193,647 | 7/1965 | Beaudoin et al. | 337/68 X |
| 3,422,384 | 1/1969 | Filchak et al. | 337/68 X |

*Primary Examiner*—George Harris

*Attorney, Agent, or Firm*—Joseph G. Denny, III; Peter J. Patane

[57] ABSTRACT

A bimetallic circuit breaker with an electrical insulating slide interposed between the contacts thereof in the contacts open position in which the terminals, the bimetallic element, the insulator slide, the button (connected to the slide) and the spring biasing the button and the slide to the contacts open position of the circuit breaker are all carried by one of the terminals so that they may all be preassembled together and inserted into the housing for the circuit as one sub-assembly.

9 Claims, 8 Drawing Figures

BIMETALLIC CIRCUIT BREAKER

BACKGROUND OF THE INVENTION

This invention relates generally to electric circuit breakers of the bimetallic type.

There is a need for a bimetallic circuit breaker which has an elongated form and whose outer housing would be generally circular in cross-section taken transverse to the longitudinal axis thereof. Such a bimetallic circuit breaker would have an outer configuration approximately corresponding to a known elongated fuse to provide a circuit interrupter which would open the circuit on predetermined conditions and which could be reset to the contacts closed position thereafter. Thus, such a bimetallic circuit breaker could be substituted in apparatus which would otherwise include a fuse.

However, since fuses are usually sold for less than comparable circuit breakers, any circuit breaker intended to be substituted for a fuse must be constructed economically so as to be competitive with fuses.

BRIEF SUMMARY OF THE INVENTION

Thus, it is an object of this invention to provide a relatively low cost and economical bimetallic circuit breaker which will be economically competitive with a comparable fuse.

Also, it is another object of this invention to provide a bimetallic circuit breaker which includes internal parts of the circuit breaker which may be assembled together as one sub-assembly, tested and then placed within the housing so as to provide an economical construction and method of assembly.

This invention provides a bimetallic circuit breaker comprising a housing which is elongated and circular in cross-section. The housing comprises an open ended tubular case. Within the case is inserted, from an open end, a sub-assembly comprising all of the internal parts of the circuit breaker.

The sub-assembly comprises an insulator body which carries the terminals, the insulator slide, the button, and the spring which biases the insulator slide and the button to the contacts open position. The spring is secured at one end to one of the terminals and at the other end to the bottom to thereby secure the bottom and the slide as part of the sub-assembly.

The foregoing and other objects of the invention, the principles of the invention and the best mode in which I have contemplated applying such principles will more fully appear from the following description and accompanying drawings in illustration thereof.

BRIEF DESCRIPTION OF THE VIEWS

DESCRIPTION OF THE PREFERRED EMBODIMENT

Figure 5:
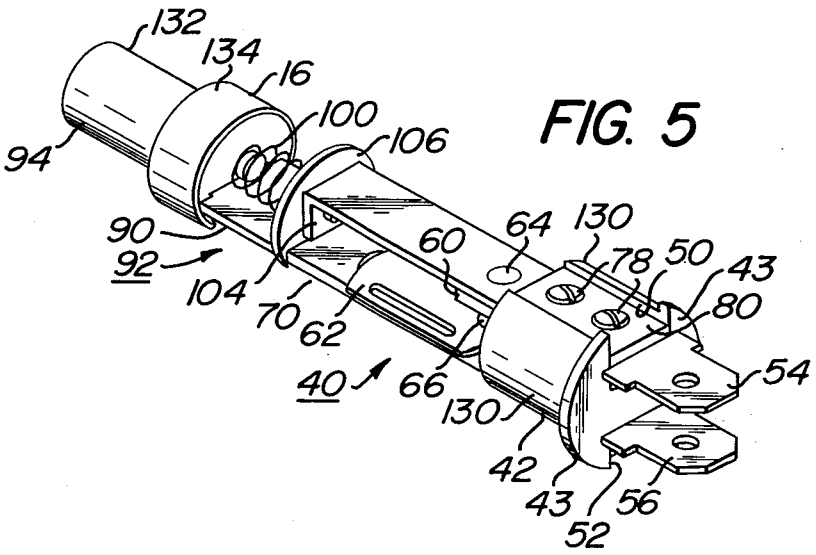
FIG. 5 is a top perspective view of the internal subassembly for the circuit breaker shown in FIGS. 1 to 4.

Referring to the drawings, the circuit breaker 10 comprises an insulator housing 12, preferably molded from an electrically insulating plastic material, consisting of a tubular case 14 having an integral cover 16. The case 14 defines an elongated circular cavity 18, FIGS. 2, 3 and 4, which is open at its opposite ends, as shown.

The case 14 is made from a suitable electrically insulating material and formed with outer and inner circular surfaces 22 24, respectively, to define a circuit breaker 10 whose appearance is that of a long cylinder.

The case 14 receives a sub-assembly 40, illustrated in perspective in FIG. 5.

The sub-assembly 40 comprises a relatively short, generally circular body or plug 42 of electrically insulating material. While the plug 42 is generally circular in cross-section, it has two opposed slots 50 and 52 which receive terminals 54 and 56, respectively. The terminals 54 and 56 are secured to the plug 42 as hereinafter described in further detail.

Figure 1:
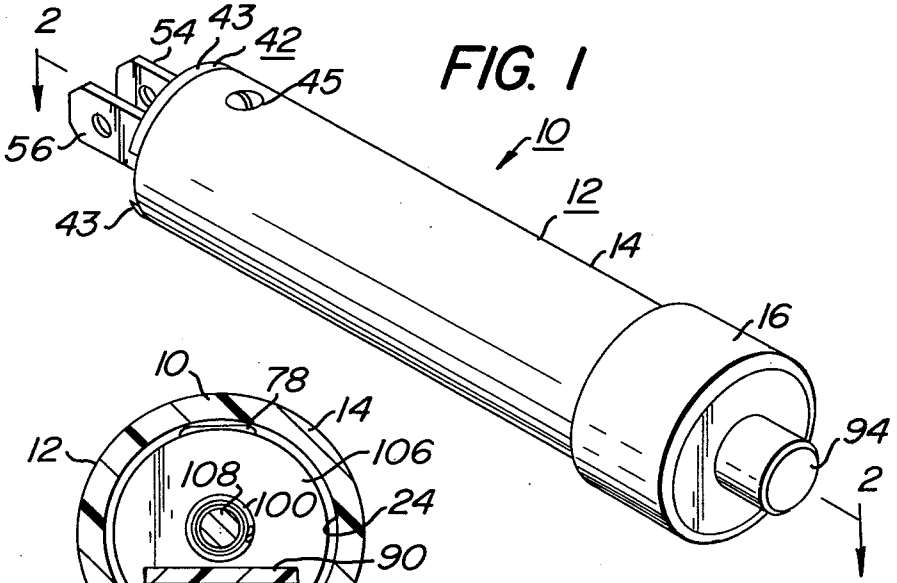
FIG. 1 is a front and top perspective view of the bimetallic circuit breaker incorporating the present invention and showing the contacts open position of the button.

The plug 42 includes radially outwardly extending semi-circular shoulders 43 which overlap and butt against the left hand surface of the case 14. A screw 45 (FIG. 1) extends through the case 14 and is threaded into the plug 42 to secure the latter to the former.

The slot 50 also receives a metallic bar 60 disposed between the terminal 54 and a central portion of the plug 42, the bar 60 carrying a bimetallic blade 62 secured to the bar 60 by a screw 64 which extends through a post 66. The bimetallic blade 62 carries a movable contact 68, as shown. The screw 64 is threaded into the bar 60 to secure the bimetallic blade 62 thereto.

The slot 52 also receives a metallic bar 70, the terminal 56 being disposed between the bar 70 and the plug 42 as shown. The bar 70 carries a stationary contact 72 which extends into a suitable hole 74 in the terminal 56.

The plug 42, the terminals 54 and 56, and the bars 60 and 70 are secured together by two screws 76 which extend through two suitable holes in the plug 42, the terminals 54 and 56, and the bars 60 and 70. The screws 76 are threaded at one end into the bar 70 and have large heads 78 extending radially beyond the shanks of the screws. A spacer 80 of electrical insulating material is provided between the screw heads 78 and the terminal 54, as shown, to insulate the screws 76 from the terminal 54 and the bar 60. Also, suitable tubes 82 (seated on the bar 70) of electrical insulating material, are provided to electrically insulate the screws 76 from the bar 60 and the terminal 54, as shown.

The right hand end portion of the terminal 56 slidably supports an actuator 92 comprising a slide 90 (which resets on the terminal 56) and a button 94 loosely connected to each other and both of electric insulating material. The slide 90 has a right hand portion which loosely extends into a slot 89 in the button 94. The slide 90 and the button 94 are connected to each other by a screw 96 which is threaded into the button 94, but loosely extends through a suitable hole 97 in the right hand end portion of the slide 90, the screw 96 having a large head, as shown, larger than the diameter of the hole 97 to loosely retain the slide 90 to the button 94. The button 94 slidably extends through a central opening in the cover 16, as shown.

Figure 2:
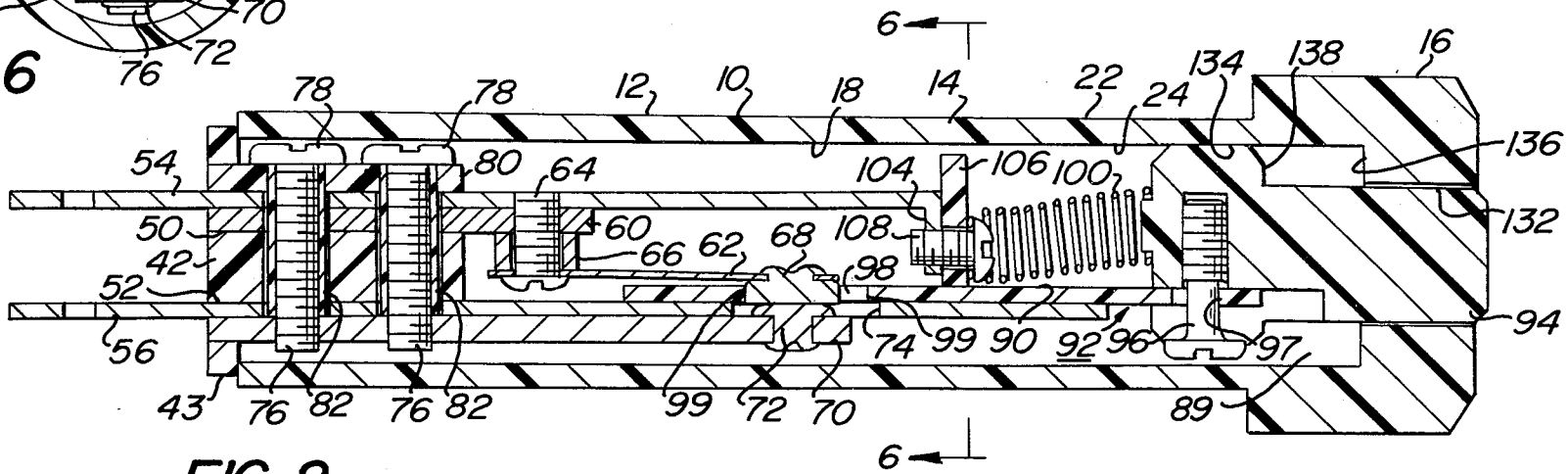
FIG. 2 is a longitudinal sectional view, taken along the line 2—2 in FIG. 1, but at a larger scale than FIG. 1, showing the contacts closed position of the circuit breaker.

Further, the slide 90 has a hole 98 (defined by a vertical wall 99) at its left hand portion which is larger than the movable contact 68 and into which the movable contact 68 extends to engage the stationary contact 72 when in the contacts closed position, FIG. 2. The slide 90 is biased to the right by a compression spring 100 but is restrained from moving to the right by the engagement of a portion of the vertical peripheral wall 99 defining the hole 98 with a portion of the peripheral vertical wall defining the movable contact 68. At such time, the right hand portion of the screw 96 engages the right hand portion of the wall defining the opening 97.

The terminal 54 has a right hand end portion 104 bent at an approximate right angle to its major portion and a washer 106 of electrical insulating material is secured thereto by a screw 108.

The left hand end of the spring 100 is trapped between the washer 106 and the head of the screw and secured thereto. The right hand end of the spring 100 is suitably secured around a locating boss to the left hand end face of the button 94.

Figure 4:
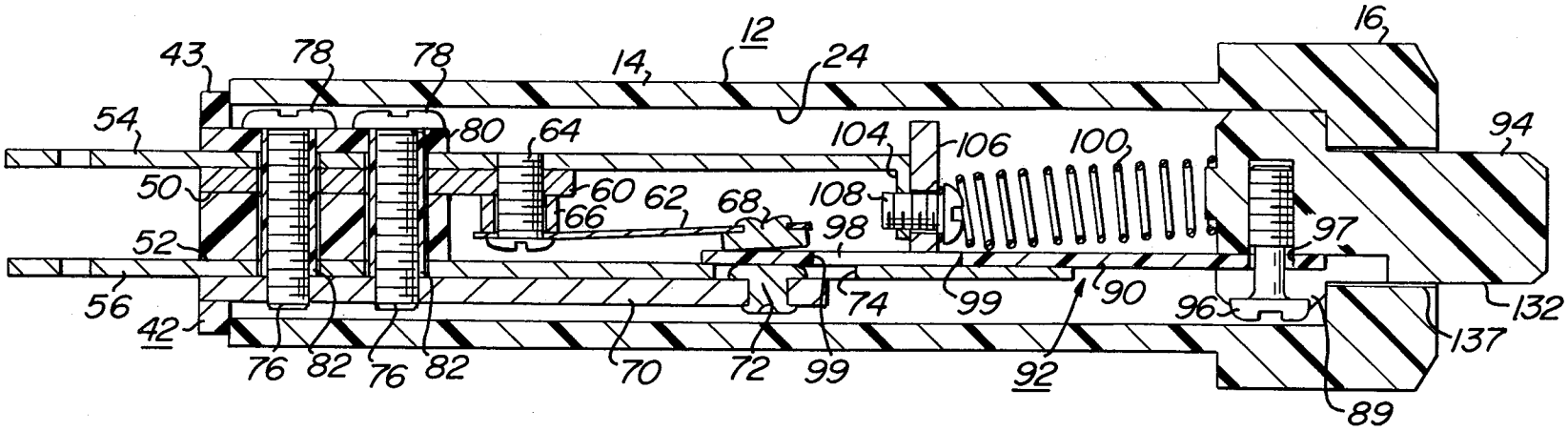
FIG. 4 is a longitudinal sectional view, similar to FIG. 3, but showing the contacts open position of the circuit breaker.
Figure 3:
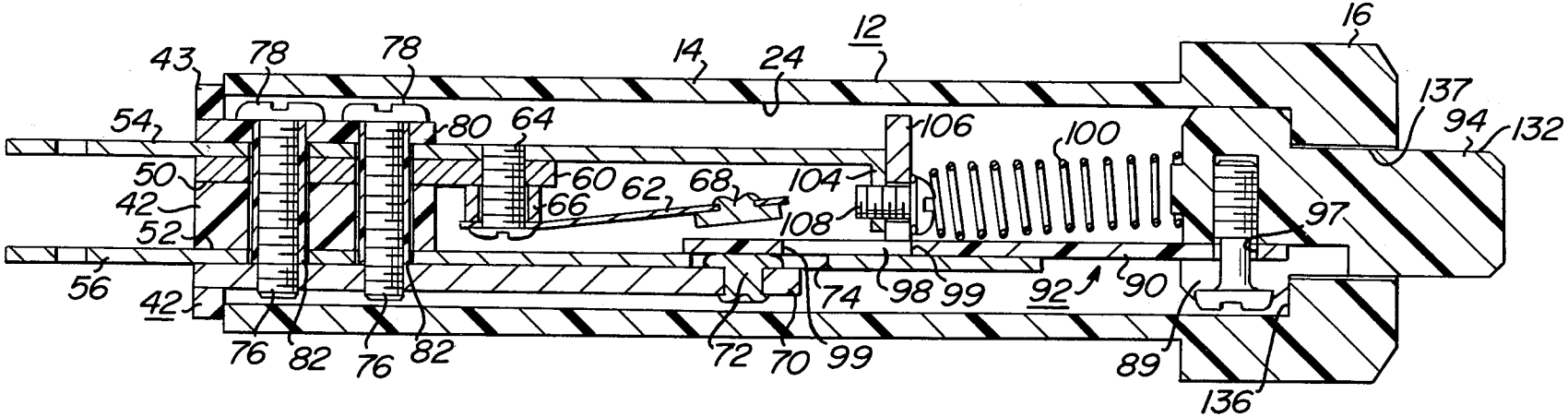
FIG. 3 is a longitudinal sectional view, similar to FIG. 2, but showing the momentary, tripped open, position of the bimetallic blade.

Assuming the circuit breaker to be in the contacts closed position as shown in FIG. 2, upon a sufficient overload, the bimetal becomes heated sufficiently to snap to the momentarily tripped position of FIG. 3 in which the movable contact moves up disengaging itself from the slide 90, whereupon the slide 90 is free to move to the right under pressure of the spring 100, the slide 90 and button 94 moving to the positions shown in FIGS. 3 and 4.

Figure 6:
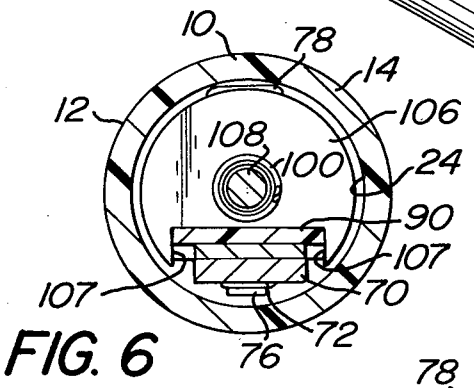
FIG. 6 is a cross-sectional view taken along the line 6—6 in FIG. 2.

As best seen in FIG. 6, the washer 106 has an inverted U-shaped groove 107 into which fits the slide 90, the top and side walls defining the groove 107 forming a sliding fit with the slide 90 to guide the latter as it moves back and forth. Also, the insulating washer 106 insures the spacing between the terminals 54 and 56.

After tripping, the bimetallic blade 62 returns to the position illustrated in FIG. 4, i.e., it moves back toward the terminal 56, but the movable contact 68 is prevented from reengaging the stationary contact 72, because the portion of the slide to the left of the hole 98 has now moved to the right and has interposed itself between the contacts 68 and 72.

Although, the bar 60 and the terminal 54 have been shown as separate pieces, they could be integral.

Likewise, while the bar 70 and the terminal 56 have been shown as separate pieces, it will be understood that they could be of one piece construction. The two piece construction shown, however, facilitates the mounting of the stationary contact 72 on a bar 70 which is flexible, although in the illustrated embodiment the bar 70 is substantially rigid.

The bimetallic blade 62, it will be understood, is of the snap acting type developing a sufficient snap force to overcome the frictional resistance to movement between the vertical wall 99 and the vertical peripheral wall of the movable contact 68 and also the spring restraint imposed on the contact 68 by the slide 90. The bimetallic blade 62 is biased toward the stationary contact 72 up to a substantially current induced temperature at which temperature the blade snaps open and returns toward the contacts closed position upon sufficient cooling.

While the spring 100 biases the actuator 92 to the contacts open position, the latching engagement between the vertical wall 99 and the vertical surface of the movable contact 68 keeps the unit in the contacts closed position when the actuator is in the position of FIG. 2, the contacts closed position.

The plug 42 and the button 94 (of the actuator 92) are slidably received within the case 14 and the cover 16. The plug 42 has two semi-circular surfaces 130 (FIG. 5) which are slidably within the inner cylindrical surface 24. The button 94 has stepped cylindrical surfaces 132 and 134 (FIG. 5) slidably received within the cylindrical surface 24 which at the right hand end of the case 12 is stepped, as shown, to include a vertical wall 136 and an inner surface 137 of smaller diameter. The vertical wall 138 of the button 94 abuts the vertical wall 136 of the case 12 to limit movement toward the right of the button 94. Movement to the left of the button 94 when it is manually depressed is limited by the abuttment of the vertical wall 99 forming the hole 98 with the vertical wall of the movable contact 68.

The washer 106 has a diameter somewhat less than the diameter of the inner cylindrical surface 24, as shown in FIG. 6. The parts between the plug 42 and the button 94 are all disposed within the volume bounded by semi-circular surfaces 130 and the larger diameter surface 134 so as to permit unobstructed insertion of the sub-assembly 40 within the case 12.

The circuit breaker shown is of the automatic off, manually on type. That is, it may not be manually moved to the contacts open position, because in the contacts closed position the button 94 does not extend sufficiently out of the cover 16 when the unit is in the contacts closed position, FIG. 2 and movement to the right would, in any event, be blocked by the engagement of the vertical wall 99 and the movable contact 68 when the contacts 68 and 72 are in the closed position, FIG. 2.

From the foregoing it is seen that the loose connection between the slide 90 and the button 94 will accommodate any tendency to cock or twist the slide 90 which may take place for various reasons, such as the off center location of the slide 90 relative to the longitudinal axis of the button 94 or manufacturing tolerances, the slide 90 tending to remain in its preferred horizontal position against the terminal 56 and guided by the washer 106, by virtue of the loose connection.

Figure 7:
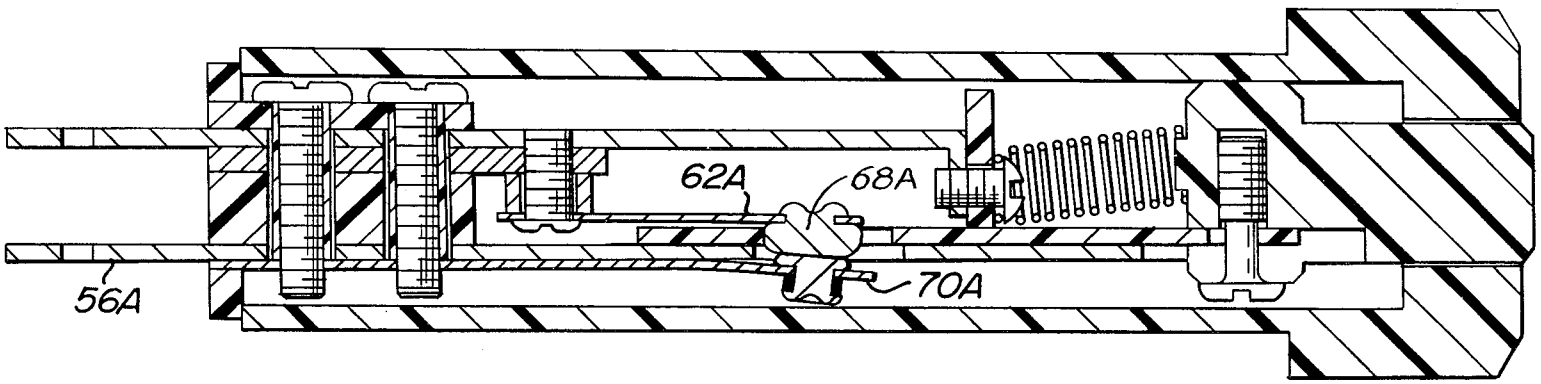
FIG. 7 is a cross-sectional view similar to FIG. 2, but showing a modified stationary contact.

A modification is shown in FIG. 7 in which the bar 70A is made to be flexible, for example, by being constructed from suitable, thin spring material. This will insure that a reasonable contact pressure is maintained as the bimetallic blade approaches its snap position. To this end the flexible bar 70A is pre-loaded and positioned relative to the other parts so that it can move up, as viewed in FIG. 7, when the movable contact 68A moves up, just prior to the snap open movement of the bimetallic blade 62A.

Since the bar 70A is flexible and of spring material, it will maintain reasonable contact pressure as the bimetallic blade 62A approaches its snap position. The flexible bar 70A is initially flexed away from the terminal 56A when in the contacts closed position, and the terminal 56A provides a stop to limit the travel of the bar 70A after the bimetallic blade 62A snaps open. The flexible bar 70A bears against the terminal 56A when the bimetallic blade 62A is in the open position. That is, after the blade 62A snaps open, the bar 70A moves against the terminal 56A and remains bearing against the terminal 56A, thus insuring adequate open contact gap or spacing. The advantage of the foregoing is that any slow movement (in the opening direction) of the bimetal blade 62A prior to its snapping open is mechanically followed by the flexible bar 70A, because it is preloaded. Thus, any tendency to "cycle", i.e., any tendency for the contacts to repeatedly open slightly (without snapping open) and when reclosing as the bimetallic blade 62A cools is minimized.

Figure 8:
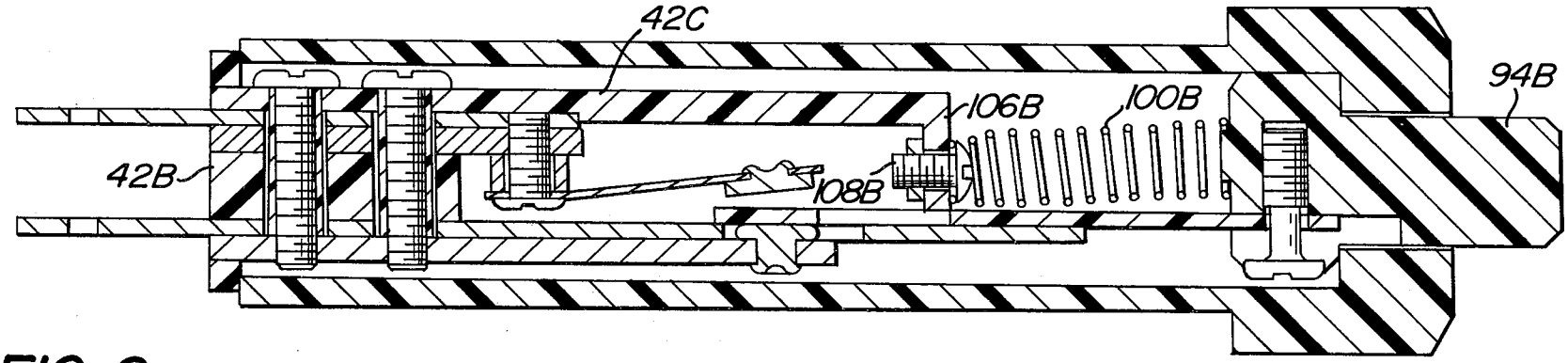
FIG. 8 is a cross-sectional view similar to FIG. 3, but showing a modified body.

A further modification is shown in FIG. 8 in which the body 42B has been extended to the right by an integral arm 42C extending horizontally toward the button 94B and having a vertical integral extension 106B to which the screw 108B is threaded for securing the spring 100B directly to the body 42B. The extension 106B in FIG. 8 also performs the functions of the washer 106 of the first described embodiment.

It will be also observed from the foregoing that by providing the unitary sub-assembly 40 which contains all of the operating parts of the circuit breaker secured to each other with the contacts 68 and 72 properly positioned relative to each other, the sub-assembly may be electrically tested in a suitable test jig (and, if need be, adjusted) prior to insertion of the sub-assembly into the housing 12.

Having described the invention, it is claimed:

1. A bimetallic circuit breaker comprising
a housing,
a sub-assembly received within said housing and comprising
a body extending within said housing,
first and second terminals carried by said body,
said first terminal including a stationary contact,
said second terminal including a bimetallic blade having a movable contact,
said bimetallic blade being movable on predetermined conditions from a contacts closed position to a contacts tripped position and thereafter to a contacts open position,
an actuator operatively carried by said body and interposed between said contacts for movement between contacts closed and opened positions,
said actuator having an opening through which said movable contact extends to abut said stationary contact to restrain movement of said actuator by engagement of said movable contact with said actuator,
a spring operatively carried by said body and biasing said actuator to the contacts open position,
said actuator extends out of said housing upon electrical tripping opening of said contacts,
said body includes a wall for properly spacing said contacts from each other, and
said actuator has a portion mating with said wall for guiding slidable movement of said actuator relative to said wall as said actuator moves back and forth between the contacts closed and open positions.

2. A bimetallic circuit breaker comprising
a housing,
a sub-assembly received within said housing and comprising
a body extending within said housing,
first and second terminals carried by said body,
said first terminal including a stationary contact,
said second terminal including a bimetallic blade having a movable contact,
said bimetallic blade being movable on predetermined conditions from a contacts closed position to a contacts tripped position and thereafter to a contacts open position,
an actuator operatively carried by said body and interposed between said contacts for movement between contacts closed and opened positions,
said actuator having an opening through which said movable contact extends to abut said stationary contact to restrain movement of said actuator by engagement of said movable contact with said actuator,
a spring operatively carried by said body and biasing said actuator to the contacts open position,
said actuator extends out of said housing upon electrical tripping opening of said contacts,
said body includes a wall for properly spacing said contacts from each other,
said bimetallic blade is mounted on a post and said movable contact is positioned between said post and
said wall,
said spring is secured to said wall, and
said wall guides said actuator as it moves between the contacts closed and contacts opened positions.

3. A bimetallic circuit breaker comprising a housing,
sub-assembly received within said housing and comprising
a body extending within said housing,
first and second terminals carried by said body,
said first terminal including a stationary contact,
said second terminal including a bimetallic blade having a movable contact,
said bimetallic blade being movable on predetermined conditions from a contacts closed position to a contacts tripped position and thereafter to a contacts open position,
an actuator operatively carried by said body and interposed between said contacts for movement between contacts closed and opened positions,
said actuator having an opening through which said movable contact extends to abut said stationary contact to restrain movement of said actuator by engagement of said movable contact with said actuator,
a spring operatively carried by said body and biasing said actuator to the contacts open position,
said actuator extends out of said housing only upon electrical tripping opening of said contacts,
said body operatively includes a first wall dividing the interior of said housing longitudinally into first and second spaces,
said body operatively including a second wall,
said bimetallic blade is mounted on said second wall and is disposed in said first space,
said spring abutts said first wall at one and and extends into said second space,
said terminals, bimetallic blade, and body extend along the same longitudinal axis,
said terminals extend beyond said housing at the same end of said body,
said housing includes an open ended tubular case closed at one end by said body and closed at the opposite end by said actuator,
said body has openings through which said terminals extend, a cover partially closing the end of said case opposite said terminals, said terminals being secured to said body, said tubular case slidably receiving said body and said actuator, said actuator comprises a slide and button hinged to each other, and said spring being disposed at its other end against said button.

4. A bimetallic circuit breaker comprising a housing, a sub-assembly received within said housing and comprising a body extending within said housing, first and second terminals carried by said body, said first terminal including a stationary contact, said second terminal including a bimetallic blade having a movable contact, said bimetallic blade being movable on predetermined conditions from a contacts closed position to a contacts tripped position and thereafter to a contacts open position, an actuator operatively carried by said body and interposed between said contacts for movement between contacts closed and opened positions, said actuator having an opening through which said movable contact extends to abut said stationary contact to restrain movement of said actuator by engagement of said movable contact with said actuator, a spring operatively carried by said body and biasing said actuator to the contacts open position, a flexible member upon which said stationary contact is mounted, and a conductive bar to which said flexible member is electrically connected at one end portion and which forms a stop for the opposite end portion of said flexible bar when said flexible bar moves to the contacts open position.

5. A bimetallic circuit breaker comprising a housing, a sub-assembly received within said housing and comprising a body extending within said housing, first and second terminals carried by said body, said first terminal including a stationary contact, said second terminal including a bimetallic blade having a movable contact, said bimetallic blade being movable on predetermined conditions from a contacts closed position to a contacts tripped position and thereafter to a contacts open position, an actuator operatively carried by said body and interposed between said contacts for movement between contacts closed and opened positions, said actuator having an opening through which said movable contact extends to abut said stationary contact to restrain movement of said actuator by engagement of said movable contact with said actuator, and a spring operatively carried by said body and biasing said actuator to the contacts open position, said spring having one end secured to one of said terminals and the other end secured to said actuator.

6. The structure recited in claim 1 wherein said terminals and bimetallic blade extend along the same longitudinal axis, and said body and said actuator are slidably received within said housing.

7. The structure recited in claim 6 wherein said terminals extend beyond said body at the same end of said body, said housing includes an open ended tubular case closed at one end by said body and closed at the other end by said actuator, and said body having opening through which said terminals extend.

8. The structure recited in claim 7 wherein said body includes a wall to limit movement of said sub-assembly into said housing.

9. The structure recited in claim 8 wherein said tubular case slidably receives said body.

* * * * *